United States Patent [19]

Schulte

[11] Patent Number: 4,819,290

[45] Date of Patent: Apr. 11, 1989

[54] SWEEPING MACHINE

[75] Inventor: Hermann Schulte, Salzbergen, Fed. Rep. of Germany

[73] Assignee: Hermann Schulte GmbH & Co. KG, Salzbergen, Fed. Rep. of Germany

[21] Appl. No.: 200,610

[22] Filed: May 31, 1988

[30] Foreign Application Priority Data

Jul. 16, 1987 [DE] Fed. Rep. of Germany ..... 870978

[51] Int. Cl.[4] ..... E01H 1/04

[52] U.S. Cl. ..... 15/83

[58] Field of Search ..... 15/79 R, 79 A, 83, 41 R, 15/340

[56] References Cited

FOREIGN PATENT DOCUMENTS

| | | | |
|---|---|---|---|
| 0230072 | 7/1987 | European Pat. Off. | 15/83 |
| 1524953 | 9/1978 | United Kingdom | 15/83 |
| 2160091 | 12/1985 | United Kingdom | 15/83 |
| 8604626 | 8/1986 | World Int. Prop. O. | 15/83 |

*Primary Examiner*—Edward L. Roberts

*Attorney, Agent, or Firm*—Jordan and Hamburg

[57] ABSTRACT

A sweeping machine includes a housing and a rotary broom rotatably supported in the housing, the rotary broom being rotatable about an axis perpendicular to the direction of movement of the sweeping machine. A collection container is provided having an opening for receiving the sweeping swept by the rotary broom, pivot support means being mounted on the housing for pivoting the container between an operable position to receive sweepings and an emptying position for emptying collected sweepings from the container. A pivotal flap is pivotably mounted on the container adjacent the container opening and pivotal between a retention position in which the pivot flap retains the collected sweepings in the container when the latter is in its operable position and a discharge position which allows the collected sweepings to be emptied from the container when the latter is in its emptying position.

16 Claims, 3 Drawing Sheets

SWEEPING MACHINE

The invention concerns a sweeping machine especially for attachment to a forklift or similar commercial or utility vehicles.

In other sweeping machines of this type, a discharge-securing profile with a triangular cross-section is fastened at that end of the container bottom which faces the rotary broom. During the sweeping operation, this is supposed to prevent the discharge of especially fine-grained, dry dust and sand particles, as well as dirt adhering to the container fill area, such as, e.g., muddy sweepings. The collection container is to be emptied above the fill opening in a position that is pivoted or flipped downwards. Consequently, the discharge-securing angle profile cannot be very high, however, so that the container can still be emptied. With known machines, it is therefore nearly unavoidable that already-swept areas are contaminated during the course of the sweeping operation as a result of dirt issuing from the collection container.

It is an object of the present invention to provide a sweeping machine of the type mentioned in the introduction by utilizing a structurally simple means in which the discharge of swept material from the collection container during the sweeping operation is effectively prevented, but which nevertheless can be emptied completely in an easily handled manner.

According to the present invention, a flap effectively secures the collection container against the discharge of sweepings during the sweeping operation. To empty the collection container, this flap is swung into an open position which almost completely releases the container collection space. Thus, to prevent the discharge of dirt, it can be designed generously, and in its closed position it can bound the container collection space to an adequate extent.

Preferably the flap is designed as a freely movable swinging flap that is supported at the bottom of the collection container. Its pivoting axis runs at a distance above the collection container floor and parallel thereto. If the collection container is brought over into its flipped-down position for the purpose of emptying it, the swinging flap follows this motion due to its inherent weight. Without any handling effort, it is thus situated in its open position when the collection container is emptied. A freely movable swinging flap, supported at the container bottom, furthermore offers the possibility of tapping the container bottom with the swinging flap by a back-and-forth pivoting motion of the collection container, and thus loosening dirt residues which may adhere there.

As regards further advantageous developments of the invention, reference is made to the drawings and the following description.

DESCRIPTION OF THE PREFERRED EMBODIMENTS

Figure 1:
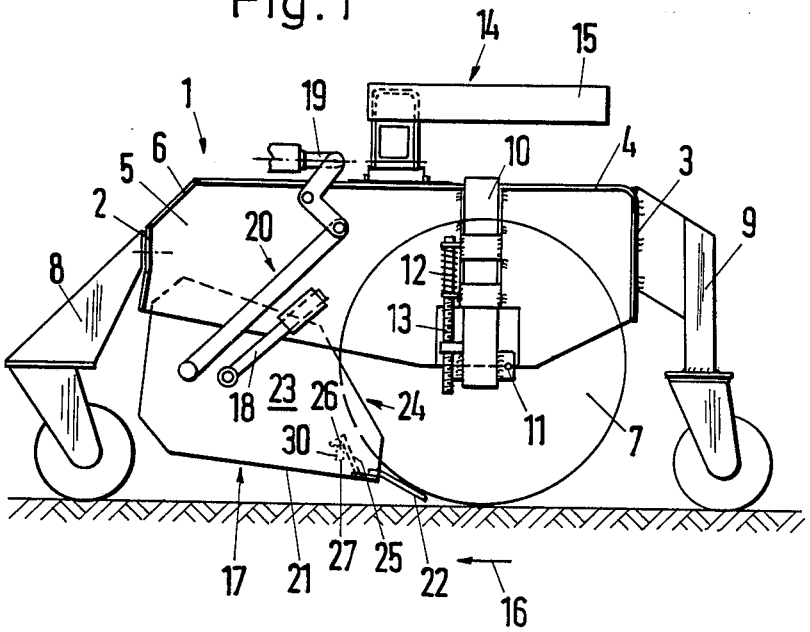
FIG. 1 is a side view of an embodiment of the sweeping machine according to the invention, with the collection container situated in the operational sweeping position.

The drawings show an embodiment of the sweeping machine according to the invention. A machine housing which in its totality is designated by 1 has front and rear boundary walls 2 and 3, an upper housing 4, as well as lateral housing walls 5 and 6, which surround the rotary sweeper in its upper area where the rotary sweeper in its totality is designated by 7. A wheel support 8, fastened at the front boundary wall 2, as well as two wheel supports 9, fastened at the rear boundary wall 3, support the machine housing 1. The wheel supports 9 can be designed so that their height is continuously adjustable. The rotary broom 7 is mounted about a horizontal axle which runs perpendicular to the running direction and can be driven by a single (not shown) hydraulic motor. The rotary broom 7 may have a hollow rolling body, which is not shown in more detail, which extends over part of the length of the rotary broom and in whose interior the hydraulic motor is disposed in a protected manner.

The rotary broom 7 is supported through fastening plates 11 at roll-lifting arms 10, with an associated pressure spring 12 as well as a thread spindle 13. In this way, the rotary broom 7 is mounted on the machine housing so that it can move up and down, Thus, under the action of its own inherent weight and of the pressure spring 13, it can automatically adjust to ground depressions and can make a vertically upward excursion when there are ground elevations.

The sweeping machine shown in the drawings has a support frame disposed on the housing cover 4 where the support frame in its totality is labeled 14. The support frame 14 has lateral support struts 15 to insert the fork of a forklift. A collection container 16 is disposed in the running direction (arrow 16) of the sweeping machine in front of the rotary broom 7. The collection container 17 is held movably by support arms 18 which are fastened at the side walls 5 and 6. By means of a swinging linkage which is equipped with a lifting cylinder 19 and which generally is labeled 20, it can be flipped or swung from the operational sweeping position shown in FIG. 1 into the discharge position shown in FIG. 2. The container bottom 21 of the collection container 17 which is open toward the rotary broom 7 has a sweeping plate 22 at its front edge which is situated in the area of a fill opening 24. Through this sweeping plate 22, the rotary broom 7 feeds the sweepings into the collection container space which is generally labeled 23.

The fill opening 24 of the collection container 7 has associated with it a discharge securing device which is designed as a pivotable flap 25. In the embodiment shown, this discharge securing device is designed as a freely movable swinging flap which extends along that front edge area of the collection container 17 that faces the rotary broom 7, and that is pivotably mounted in the container side walls. The mounting points of the swinging flap 25 have a certain distance above the container bottom 21 so that the pivoting axle 26 of the swinging flap 25 extends above the container bottom 21 as well as parallel to it. Because of its inherent weight, the flap 25 supports itself on the container bottom 21 in the operating sweep setting of the collection container 17 (FIG. 1) so that the rotary broom 7 brings the sweepings into the collection container space first over the flexible sweeping strip 22 and then over the flap 25.

The flap 25 is designed with two unequal legs which in cross section are disposed at an angle. FIGS. 3 to 6 show in detail how the flap 25, with its variably positioned pivoting axle 26, is supported at the collection container. For this purpose, the side walls of the collection container, at a distance from one another, have holes 28 disposed about a bore 27 in the container side wall and which thus always have a different vertical distance with respect to the container bottom 21. As FIG. 7 also shows, a linkage casing 32 is fastened at the flap 25 at the inside angular space that is bounded by the angled leg plates of the flap 25. A square hinge pin 29, which can be inserted through the holes 28, is introduced into linkage casing 32 on both sides of the machine housing 1. The square hinge pin 29, which can be introduced into linkage casing 32, offers among other things especially the advantage, compared to a cylindrical hinge pin, that it jams only with difficulty in the casing 32, for example, due to corrosion, and if it does jam, it can again be released relatively quickly. Flat steel bars 30, acting as flap adjusters, are fastened at the outer end of the square hinge pins 29. By means of a screw that is insertable through the bore 27, the flat steel bars 30 can be fixed at the side walls of the collection container at different inclinations with respect to the container bottom 21. The flap adjusters 30 can be secured by additional screw connections in the holes 31 at the side walls of the container. By adjusting the flap adjuster 30, the pivoting axles 26 and thus the height of the flap as well as its angle of inclination to the container bottom 21 can be changed and can be adapted to the particular contingencies so that, on the one hand, the dirt that is being swept up can be reliably brought into the collection container space 23 by the rotary broom 7 and, on the other hand, however, the dirt can be effectively prevented from exiting the collection container during the cleaning run.

Figure 2:
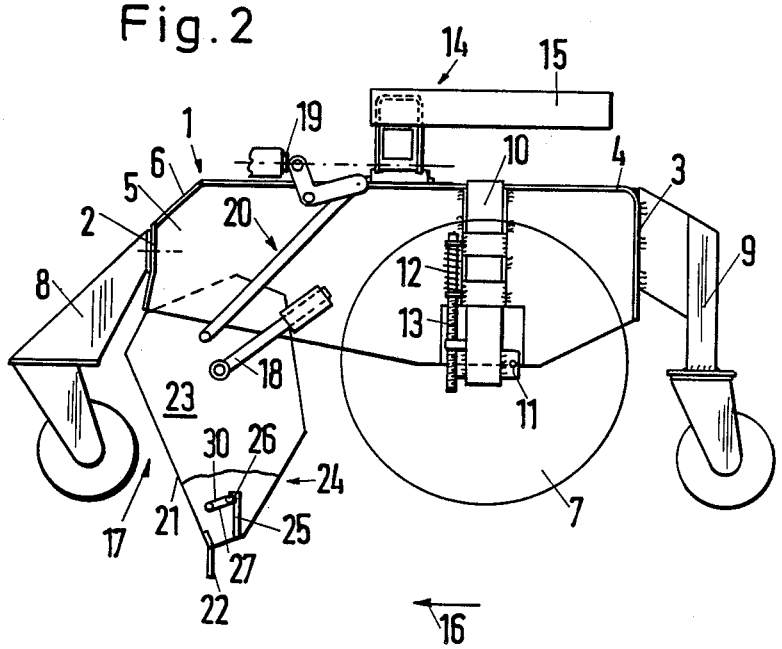
FIG. 2 is a side view of the embodiment according to FIG. 1, with the collection container swung into the discharge position.
Figure 5:
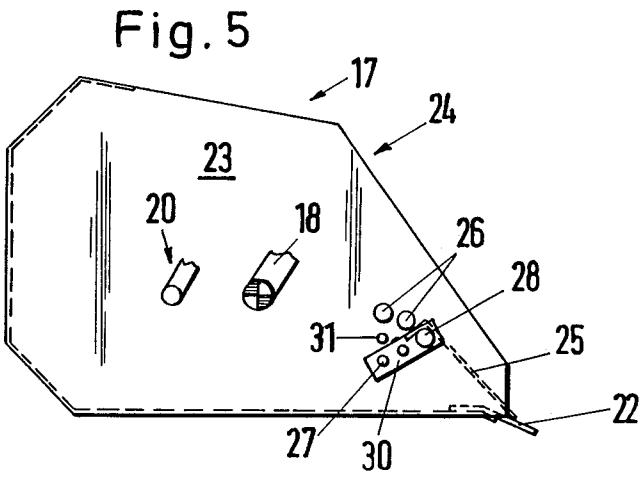
FIGS. 3–6 each show schematically the collection container of the embodiment of FIGS. 1 and 2, with the swinging flap set in different positions at the container side walls, always once in the operational sweeping position and once in the discharge position.
Figure 6:
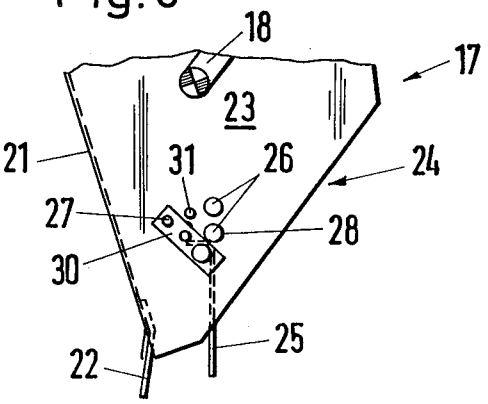
Figure 3:
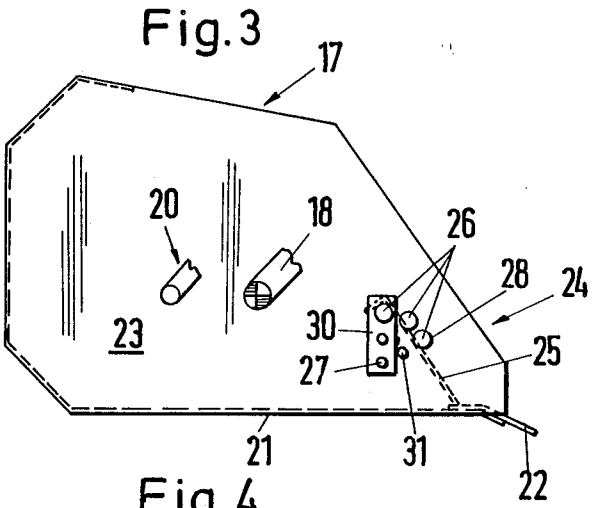
Figure 4:
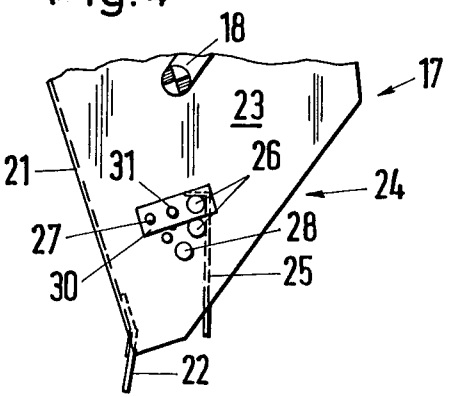
Figure 7:
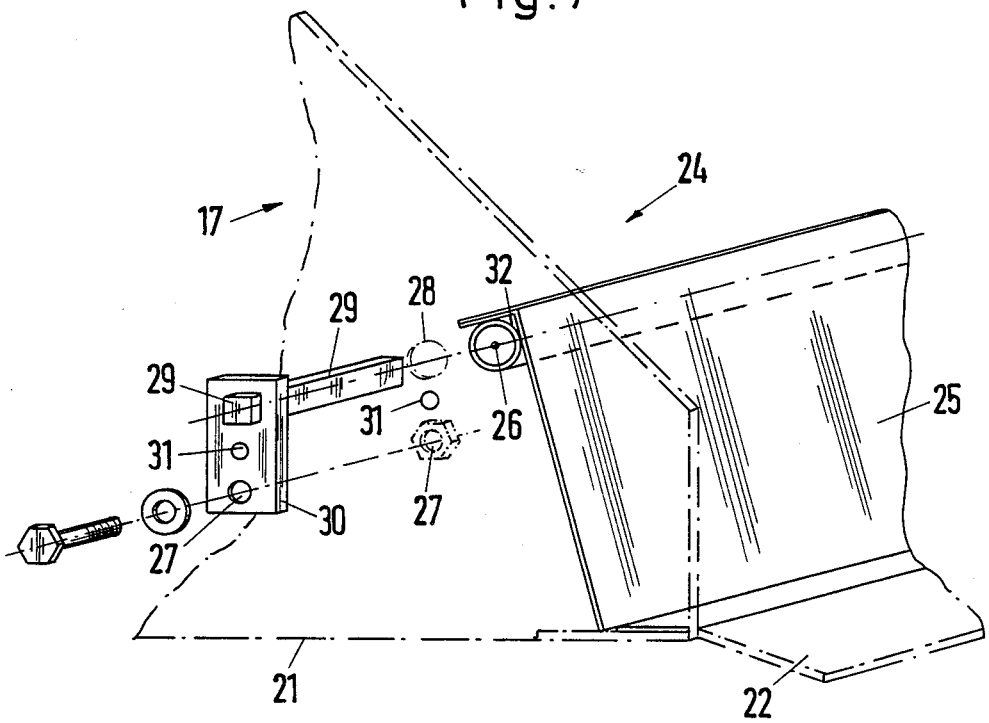
FIG. 7 is a perspective view, partly in section, of a single part representation of the collection container with its swinging flap as well as the hinge parts of the flap in a single part representation.

As FIGS. 2, 4 and 6 especially make clear, the swinging flap 25 which forms the discharge securing device does not impede emptying the container 17 when it is brought over into its flipped-down position. Rather, due to the freely movable design of the flap 25 and because of the position of its pivoting axle above the container bottom 21, it is advantageously possible to tap the container bottom 21 by means of the flap 25 through a back-and-forth swinging motion of the collection container 17. Thus, dirt particles which may adhere to the container bottom or on the container side walls can be loosened and can be discharged reliably.

What I claim is:

1. A sweeping machine comprising a housing, a rotary broom rotatably supported in said housing, said rotary broom being rotatable about an axis perpendicular to the direction of movement of the sweeping machine, a collection container having an opening for receiving the sweepings swept by said rotary broom, pivot-support means mounted on said housing for pivoting said container between an operable position to receive sweepings and an emptying position for emptying collected sweepings from the container, and pivotal flap means pivotably mounted on said container adjacent said container opening and pivotal between a retention position in which said pivotal flap means retains the collected sweepings in said container when the latter is in said operable position and a discharge position which allows said collected sweepings to be emptied from said container when the latter is in said emptying position.

2. A sweeping machine according to claim 1 wherein said pivotal flap means comprises a flap member and pivot-mounted means pivotably mounted on said container for pivotably supporting said flap member for free-swinging pivotal movement.

3. A sweeping machine according to claim 2 wherein said container has a bottom wall, said pivotal flap means being juxtaposed to said bottom wall so that said flap member extends to said bottom wall when said pivotal flap means is in said retention position.

4. A sweeping machine according to claim 3 wherein said pivot-mounted means has a pivot axis generally parallel to said bottom wall and located above said bottom wall.

5. A sweeping machine according to claim 3 wherein said bottom wall has a bottom-wall portion extending adjacent to said opening in said container, said flap member being disposed at said bottom-wall portion.

6. A sweeping machine according to claim 2 wherein said container has side walls on which said pivot-mounted means are mounted.

7. A sweeping machine according to claim 2 wherein said flap member has a generally L-shaped cross-sectional configuration with two leg portions.

8. A sweeping machine according to claim 7 wherein one of said leg portions is longer than the other leg portion.

9. A sweeping machine according to claim 2 wherein said pivot-mounted means comprises adjustment means for adjusting the position of the pivotal axis of the pivot-mounted means on said container.

10. A sweeping machine according to claim 9 wherein said container has side walls and a bottom wall, said adjustment means comprising a plurality of openings in said container side walls spaced different distances from said bottom wall.

11. A sweeping machine according to claim 9 wherein said container has a bottom wall, said adjustment means being operable to adjust said flap member at various angles relative to said bottom wall.

12. A sweeping machine according to claim 1 wherein said container comprises side walls, said pivot-support means comprising power-operated means and linkage means connected to said power-operated means, said linkage means being mounted on said side walls of said container.

13. A sweeping machine according to claim 2 wherein said pivot-mounted means comprises a casing means on said flap member, said casing means having a generally cylindrical opening, said pivot-mounted means further comprising a hinge pin having a generally square cross-section, said hinge pin being rotatably mounted in said cylindrical opening.

14. A sweeping machine according to claim 1 wherein said container has a bottom wall, said pivotal flap means contacting said bottom wall and being disposed at an acute angle relative to said bottom wall when said pivotal flap means is in said retention position, said pivot flap means being spaced from said bottom wall when said pivotal flap means is in said emptying position.

15. A sweeping machine according to claim 14 wherein said pivotal flap means is generally vertically disposed when said pivotal flap means is in said emptying position.

16. A sweeping machine according to claim 1 wherein said sweeping machine is adapted to be attached to a forklift or a similar commercial or utility vehicle.

* * * * *